US007255431B2

(12) United States Patent
Lui

(10) Patent No.: US 7,255,431 B2
(45) Date of Patent: Aug. 14, 2007

(54) INK CARTRIDGE

(75) Inventor: Pui-Kuong Lui, Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 360 days.

(21) Appl. No.: 11/092,656

(22) Filed: Mar. 30, 2005

(65) Prior Publication Data

US 2006/0227187 A1 Oct. 12, 2006

(51) Int. Cl.
*B41J 2/175* (2006.01)

(52) U.S. Cl. ..... 347/86

(58) Field of Classification Search ..... 347/85, 347/86, 87; 137/145, 171, 206
See application file for complete search history.

(56) References Cited

U.S. PATENT DOCUMENTS 4,992,802 A * 2/1991 Dion et al. ..... 347/87
5,363,130 A * 11/1994 Cowger et al. ..... 347/92
5,526,030 A * 6/1996 Baldwin et al. ..... 347/87
5,764,259 A * 6/1998 Nakajima ..... 347/86
5,988,803 A * 11/1999 Komplin et al. ..... 347/86
6,619,790 B1 9/2003 Lui et al.
6,761,441 B2 7/2004 Lui
6,783,219 B2 8/2004 Lui et al.
6,877,849 B2 * 4/2005 Gonzales ..... 347/86
6,976,753 B2 * 12/2005 Kuwabara et al. ..... 347/86

* cited by examiner

*Primary Examiner*—Anh T. N. Vo
(74) *Attorney, Agent, or Firm*—Rosenberg, Klein & Lee

(57) ABSTRACT

An ink cartridge is disclosed and includes a hollow ink tank body, a cover member connected to the body, a pressure regulator mounted on the bottom of the body, a tank disposed under the body and connected to the bottom thereof, and a hollow tube. The body is defined with a cavity therein and an outlet port formed on a bottom thereof. The cover member has a filling inlet and an air vent formed thereon. The tank corresponds to and communicates with the pressure regulator, and further has a venthole and a porous member disposed therein. The hollow tube communicates with the air vent of the cover member and the venthole of the tank. Therefore, the atmospheric air passes into the body via the hollow tube and the tank.

9 Claims, 3 Drawing Sheets

INK CARTRIDGE

BACKGROUND OF THE INVENTION

1. Field of the Invention

The present invention relates to an ink cartridge adapted for an ink jet printer, and particularly relates to an ink cartridge that can improve the ink leakage problem for additional events, such as squeezing the ink cartridge, delivery or long-period storage.

2. Background of the Invention

The ink jet recording technology is such as to record characters and images directly on a recording medium (such as paper, cloth, or plastic sheet) by discharging ink from fine nozzles thereto. Conventionally, the recording apparatus has been utilized as a printer serving and provided as the output terminal of a copying machine, a facsimile equipment, a printer, a word processor, a work station or the like; or as a handy or potable printer used for such an information processing system as a personal computer, a host computer, an optical disc device or a video apparatus. In a conventional recording apparatus, ink is supplied to a recording head from an ink tank constructed as a cartridge. A benefit of using the conventional ink cartridge serving as an ink tank is that the ink does not smear due to the leakage of ink while refilling new ink or the like. Nevertheless, undesired air bubbles can easily enter the ink tank during the filling process, which cause problems such as ink supply failure. Air trapped in the cartridge adversely impacts the ink supply to the printhead or can mix in the ink resulting in poor printing quality. To fill the ink cartridge by introducing the ink via a vacuum into the porous foam is used in an effort to limit the introduction or retention of the air bubbles in the ink cartridge.

The uses of the ink cartridge that improves various problems are disclosed in U.S. Pat. No. 6,761,441 B2, entitled "Ink Cartridge", U.S. Pat. No. 6,619,790 B1, entitled "Ink-Jet Printer Cartridge Upper Cover", U.S. Pat. No. 6,378,219 B2, entitled "Ink Cartridge", and documents related thereabout. The advantages of reference U.S. Pat. No. 6,761,441 are that it provides an accommodating chamber defining a dimension completely same as that of ink porous member so that the ink porous member is impregnated with ink under low atmospheric pressure thereby to increase the amount of the impregnated ink, and further provides a stopping member having a sealing film integrally formed without a laminated film sealed on an opening of the ink outlet port. The advantages of reference U.S. Pat. No. 6,619,790 are that it provides a non-rigid ring sealed between an upper cover and vent tip, and further provides tight seal with a cover for saving time and labor. The advantages of reference U.S. Pat. No. 6,378,219 are that it provides the elastic member for unidirectional ventilation by a pressure difference between inside and outside the hollow ink tank body without both air inlet hole and porous member. Obviously, a pressure regulator referred in these prior art is used to maintain the pressure and ink flow to the printhead continuously. However, if accidental events happen, such as squeezing the ink cartridge, delivery or long period storage, ink leakage out of the pressure regulator occurs. Alternatives of regulator pressure have been explored but have failed to adequately address the leakage issue.

It is desirable to develop a new and improved ink cartridge to substantially resolve the leakage problems and provide better, more advantageous overall results.

SUMMARY OF INVENTION

An ink cartridge adapted for an ink jet printer is provided for preventing the ink leakage problem from accidental events, such as squeezing the ink cartridge, delivery or long-period storage.

The ink cartridge adapted for an ink jet printer is provided with a hollow tube communicated with both atmosphere and a pressure regulator so that the negative pressure of the cartridge will be balanced while printing.

An ink cartridge is disclosed, and includes a hollow ink tank body defining a cavity therein and an outlet port formed on a bottom thereof; a cover member connected to the hollow ink tank body and having a filling inlet and an air vent formed thereon; a pressure regulator mounted on the bottom of the hollow ink tank body; a tank disposed under the hollow ink tank body and connected to the bottom thereof for corresponding to and communicating with the pressure regulator; and a hollow tube communicating with the air vent of the cover member and the venthole of the tank. The tank has a venthole and a porous member disposed therein. The atmospheric air communicates with the tank via the hollow tube.

To provide a further understanding of the invention, the following detailed description illustrates embodiments and examples of the invention. Examples of the more important features of the invention have thus been summarized rather broadly in order that the detailed description thereof that follows may be better understood, and in order that the contributions to the art may be appreciated. There are, of course, additional features of the invention that will be described hereinafter which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

There is a permeable membrane attached on the lower surface of the pressure regulator. When the ink is drawn out of the printhead, the equivalent air would be drawn from the pressure regulator to balance the negative pressure within the ink cartridge thru the atmosphere directly. For security, additional parts will be added to improve the ink leakage problem according to the present invention.

Figure 1:
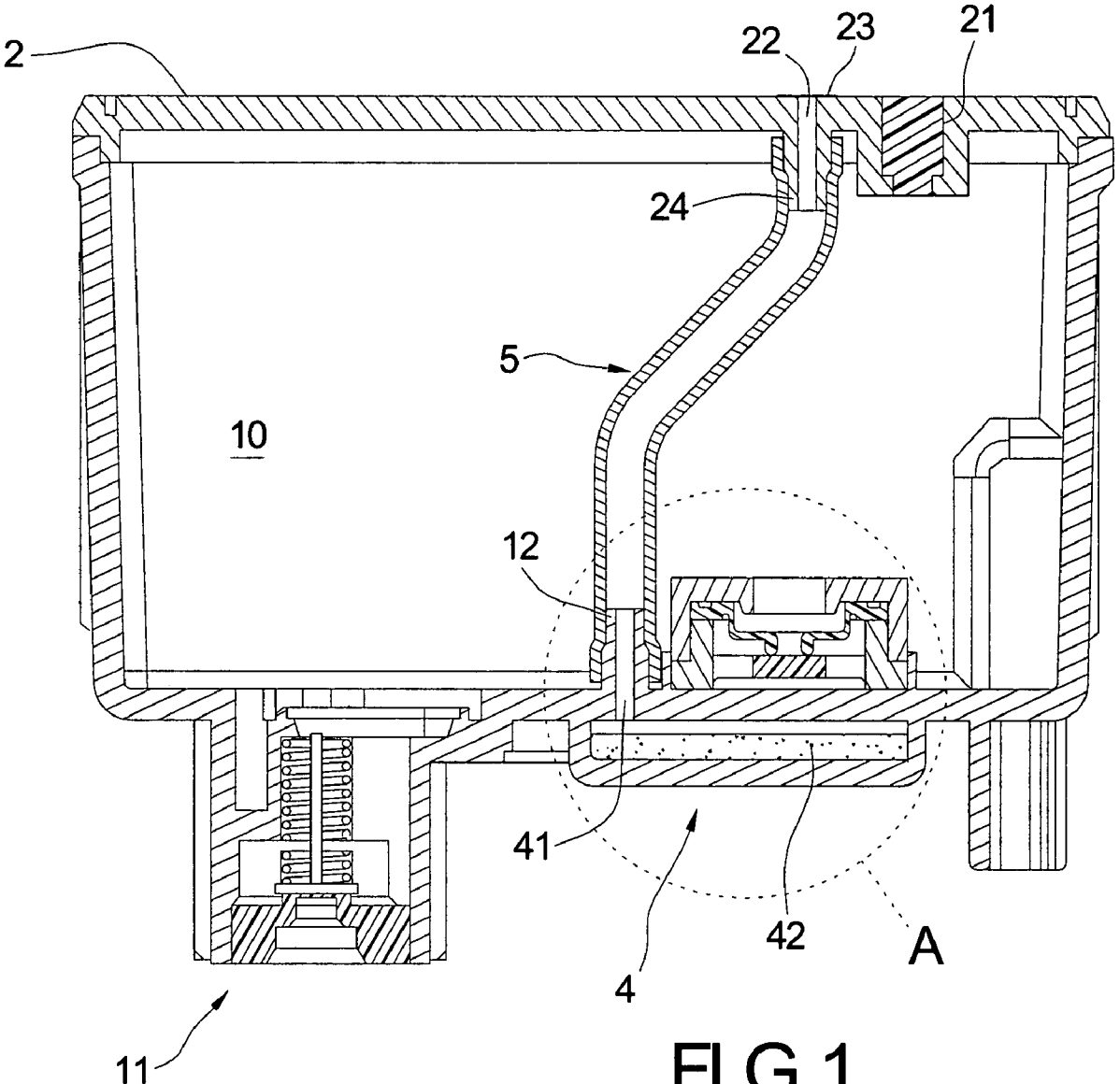
FIG. 1 is a cross-sectional profile of a first embodiment of an ink cartridge according to the present invention.

Referring to FIG. 1, an ink cartridge of a first embodiment according to the present invention includes a hollow ink tank body 1, a cover member 2 connected to the hollow ink tank body 1, a pressure regulator 3 mounted to a bottom of the hollow ink tank body 1, a tank 4 disposed under the hollow ink tank body 1 and connected to a bottom thereof, and a hollow tube 5 communicating with the atmosphere and the tank 4 via a venthole 41 that is formed to communicated with the tank 4 and the hollow ink tank body 1. The hollow ink tank body 1 defines a cavity 10 therein for fill with ink and an outlet port 11 formed on a bottom thereof for delivering the ink outwards. The cover member 2 has a filling inlet 21 for inputting the ink, an air vent 22 formed thereon, and a film 23 sealed the air vent 22. The hollow tube 5 is used to communicate the venthole 41 of the tank 4 and the air vent 22 of the cover member 2. After the film 23 is peeled off, the atmospheric air can pass into the regulator 3 via the hollow tube 5 and the tank 4 sequentially; in order to maintain the pressure balance inside the hollow ink tank body 1 and ink flow to the printhead continuously.

Figure 1A:
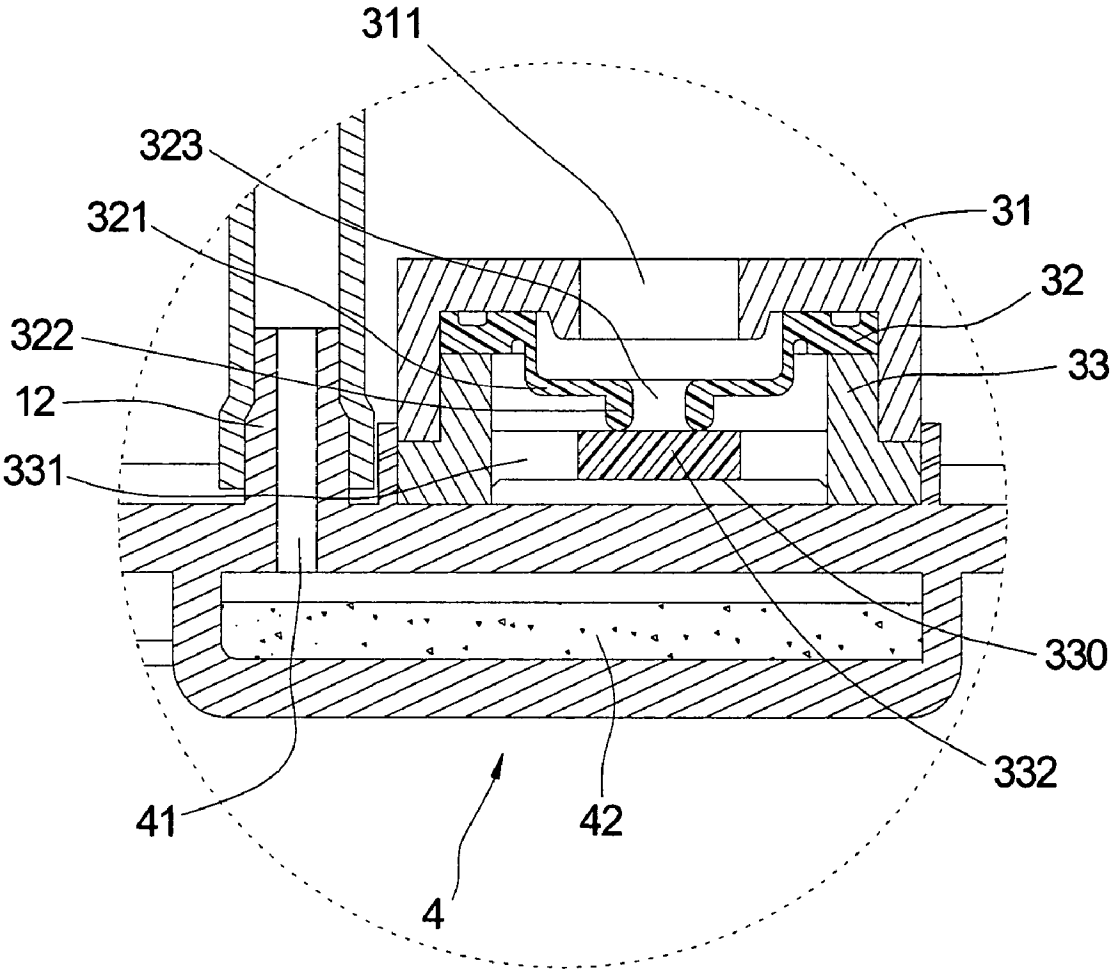
FIG. 1A is an enlarged view of a pressure regulator of the ink cartridge according to the present invention.

With respect to FIG. 1A, the pressure regulator 3, similar with the U.S. Pat. No. 6,783,219 B2, includes a box body 31 as an upper part thereof, an elastic member 32 as a middle part thereof and a cover body 33 as a lower part thereof. The upper and lower parts are constructed by rigid material; the middle part is made of non-rigid, elastic and flexible material. The box body 31 has an passageway 311 thereon; the cover body 33 has an inner layer 330 formed one or more holes 331 on a periphery thereof defining a platform 332 between the air holes 331 thereon; the elastic member 32 has a valve layer 321 formed a ring 322 thereon defining a central hole 323; and the ring 322 is placed on and sealed the platform 332 of the cover body 33. The hollow ink tank body 1 further includes an opening for the pressure regulator 3 communicating with the tank 4.

The tank 4 corresponding to the pressure regulator 3 is used to enclose the hollow ink tank body 1 to prevent an unexpected ink leakage. The tank 4 further has a porous member 42 disposed inside to absorb the excessive ink from the pressure regulator 3. Thus, the hollow tube 5 communicates with the air vent 22 of the cover member 2 and the venthole 41 of the tank 4 so that the atmospheric air can communicate with the tank 4 via the hollow tube 5, and the pressure regulator 3 allows the atmospheric air pass from the tank 4 through it if required.

According to this embodiment in FIG. 1, the hollow tube 5 is placed inside the hollow ink tank body 1. In addition, the cover member 2 has a first through-hole protrusion 24 extending therefrom and communicating with the air vent 22, and the hollow ink tank body 1 has a second through-hole protrusion 12 extending from the bottom thereof and communicating with the tank 4; therefore, the hollow tube 5 is inserted with the first and the second through-hole protrusions 24, 12 for guiding the atmospheric air into the tank 4, so that the negative pressure inside the hollow ink tank body 1 can be balanced by the atmosphere air from the tank 4 via the hollow tube 5. Each of the first and the second through-hole protrusions 24, 12 can be cylindrical for fitting with the hollow tube 5. Furthermore, the air vent 22 of the cover member 2 may have a diameter same as or smaller than that of the first through-hole protrusion 24.

Figure 2:
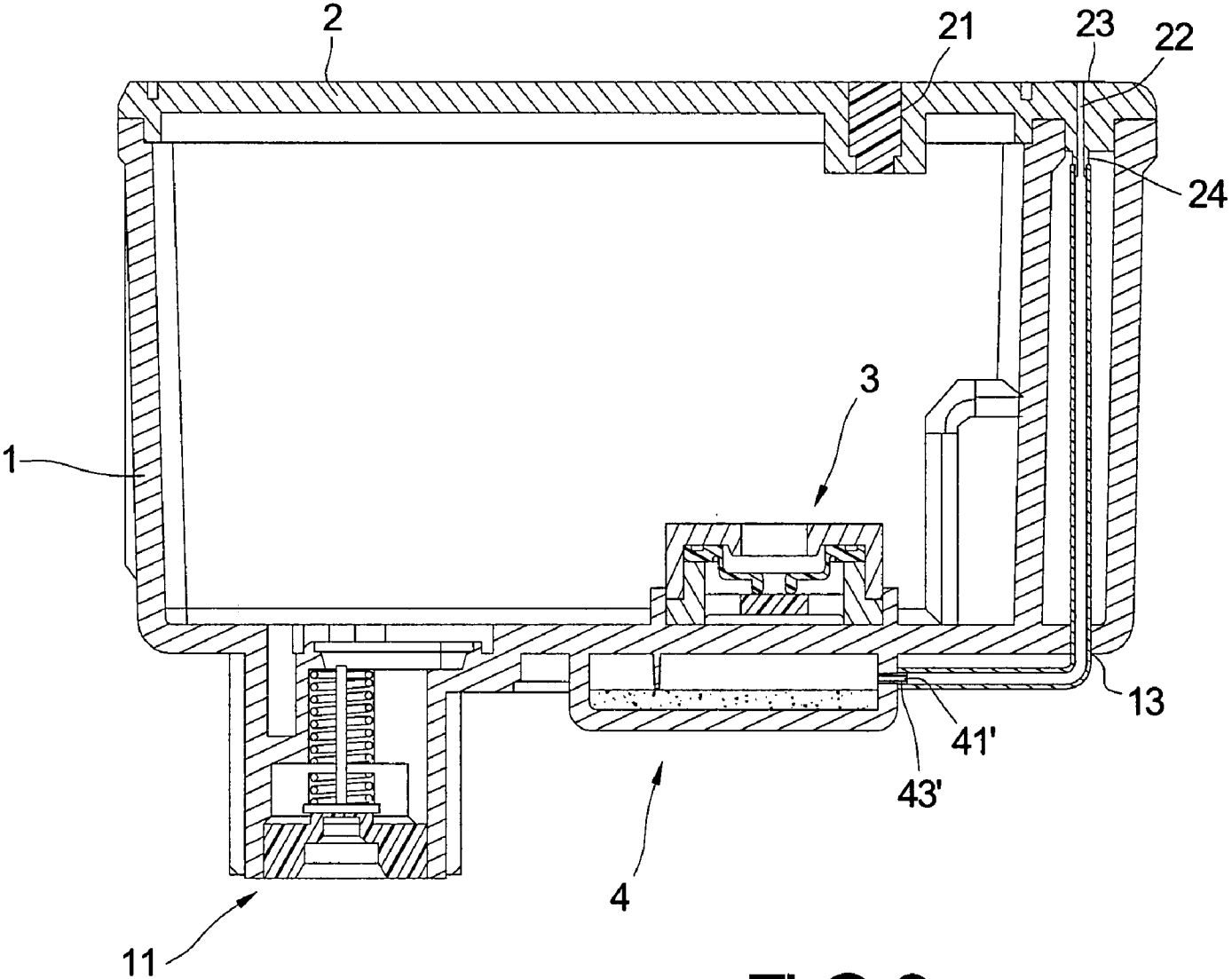
FIG. 2 is a cross-sectional profile of a second embodiment of the ink cartridge according to the present invention.

Referring to FIG. 2, a second embodiment of the ink cartridge according to the present invention is disclosed, the hollow tube 5 is inserted along an emarginated corner of the hollow ink tank body 1, and penetrates through a channel 13 that is formed on the bottom of the hollow ink tank body 1. The hollow tube 5 communicates with the air vent 22 of the cover member 2 and a venthole 41' of the tank 4 via the channel 13. The venthole 41' is formed on the tank 4 but away from hollow ink tank body 1, and the tank 4 has a second through-hole protrusion 43' extending outwardly therefrom and communicating with the venthole 41' thereof. The first and the second through-hole protrusions 24, 43' are sleeved by two ends of the hollow tube. As same as the first embodiment, each of the first and the second through-hole protrusions 24, 43' can be cylindrical for fitting with the hollow tube 5. Furthermore, the air vent 22 of the cover member 2 may have a diameter same as or smaller than that of the first through-hole protrusion 24.

The ink cartridge according to the present invention is unlimited to a single colored ink cartridge, the combination of the both embodiments or one of the embodiments could be applied to a multi-colored ink cartridge as well.

According to the present invention, the advantages of the ink cartridge are described as followed:

1. The ink cartridge can absorb the excessive ink from the pressure regulator in order to prevent the ink leakage problem from accidental events, such as squeezing the ink cartridge, delivery or long-period storage.

2. The ink cartridge can provide the hollow tube communicated with atmosphere and the pressure regulator, so that the negative pressure of the ink cartridge will be balanced while printing.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An ink cartridge comprising:

a hollow ink tank body defining a cavity therein, and an outlet port formed on a bottom thereof;

a cover member connected to the hollow ink tank body, and having a filling inlet and an air vent formed thereon;

a pressure regulator mounted on the bottom of the hollow ink tank body;

a tank disposed under the hollow ink tank body and connected to the bottom thereof, and the tank corresponding to and communicating with the pressure regulator, wherein the tank has a venthole formed thereon and a porous member disposed therein; and a hollow tube communicating with the air vent of the cover member and the venthole of the tank;

whereby atmospheric air passes through the pressure regulator via the hollow tube.

2. The ink cartridge as claimed in claim 1, wherein the hollow tube is disposed inside the hollow ink tank body.

3. The ink cartridge as claimed in claim 2, wherein the cover member has a first through-hole protrusion extending therefrom and communicating with the air vent, and the hollow ink tank body has a second through-hole protrusion extending from the bottom thereof and communicating with the venthole of the tank; therefore, the first and the second through-hole protrusions are sleeved by two ends of the hollow tube.

4. The ink cartridge as claimed in claim 3, wherein each of the first and the second through-hole protrusions is cylindrical.

5. The ink cartridge as claimed in claim 3, wherein the air vent has a diameter same as or smaller than that of the first through-hole protrusion.

6. The ink cartridge as claimed in claim 1, wherein the hollow tube is inserted along an emarginated corner of the hollow ink tank body, and penetrates through a channel that is formed on the bottom of the hollow ink tank body and further communicates with the air vent of the cover member and the venthole of the tank.

7. The ink cartridge as claimed in claim 6, wherein the cover member has a first through-hole protrusion extending therefrom and communicating with the air vent, and the tank has a second through-hole protrusion extending outwardly therefrom and communicating with the venthole thereof;

therefore, the first and the second through-hole protrusions are sleeved by two ends of the hollow tube.

8. The ink cartridge as claimed in claim 7, wherein each of the first and the second through-hole protrusions is cylindrical.

9. The ink cartridge as claimed in claim 7, wherein the air vent has a diameter same as or smaller than that of the first through-hole protrusion.

* * * * *